US006688998B2

(12) United States Patent
Hergert et al.

(10) Patent No.: US 6,688,998 B2
(45) Date of Patent: Feb. 10, 2004

(54) SPORT BALL TRAINING DEVICE

(75) Inventors: Layne E. Hergert, Omaha, NE (US); John H. Valdez, Jr., Omaha, NE (US); Shellie J. Valdez, Omaha, NE (US)

(73) Assignee: Marty Gilman, Inc., Gilman, CT (US)

( * ) Notice: Subject to any disclaimer, the term of this patent is extended or adjusted under 35 U.S.C. 154(b) by 0 days.

(21) Appl. No.: 10/128,030

(22) Filed: Apr. 22, 2002

(65) Prior Publication Data

US 2002/0115509 A1 Aug. 22, 2002

Related U.S. Application Data

(63) Continuation-in-part of application No. 09/677,316, filed on Sep. 29, 2000, now Pat. No. 6,398,677.

(51) Int. Cl.[7] ..... A63B 41/08
(52) U.S. Cl. ..... 473/599; 473/596; 473/603
(58) Field of Search ..... 473/596, 597, 473/599, 603, 613; 224/919

(56) References Cited

U.S. PATENT DOCUMENTS

| | | | |
|---|---|---|---|
| 1,666,099 | A | 4/1928 | Kingman |
| 2,270,553 | A | 1/1942 | Potito |
| 2,931,653 | A | 4/1960 | Gow et al. |
| 4,625,336 | A | 12/1986 | Derderian |
| 4,676,376 | A | 6/1987 | Keiswetter |
| 4,822,371 | A | 4/1989 | Jolly et al. |
| 5,115,650 | A | 5/1992 | Patrick et al. |
| 5,135,222 | A | 8/1992 | Spector |
| 5,261,661 | A | 11/1993 | Lemmon |
| 5,730,287 | A | 3/1998 | Martin |
| 5,779,578 | A | 7/1998 | Calandro |
| 5,984,812 | A | 11/1999 | Sassak |
| 5,997,422 | A | 12/1999 | Cooper |
| 6,398,677 | B1 | 6/2002 | Hergert et al. |

*Primary Examiner*—Steven Wong
(74) *Attorney, Agent, or Firm*—Thomte, Mazour & Niebergall; Shane M. Niebergall

(57) ABSTRACT

Through the use of flexible materials having a coefficient of friction lower than that of conventional sport balls, a sport ball training cover is created. The flexible material is fashioned into a pocket that snugly but removably covers the sport ball. The cover supplants its coefficient of friction to the sport ball, making it difficult to handle and creating a valuable training device for proper ball-handling. In another embodiment, a permanent training sport ball is formed by permanently attaching the flexible material to the outer cover of the ball. Other embodiments of the covers, that removably or permanently cover the sport balls, have different shapes and vary the amount of flexible material used to leave selected areas of the sport ball, such as the laces of a football, uncovered. The versatility and variety of the covers make them useful for any number of different training drills and sports.

10 Claims, 2 Drawing Sheets

SPORT BALL TRAINING DEVICE

CROSS-REFERENCE TO RELATED APPLICATION

This is a continuation-in-part application of Petitioner's earlier application Ser. No. 09/677,316 filed Sep. 29, 2000, entitled SPORT BALL TRAINING COVER now U.S. Pat. No. 6,398,677.

BACKGROUND OF THE INVENTION

1. Field of the Invention

The present invention relates to the field of sports training devices, and more particularly to a covering for a sport balls that, when applied to a sport ball, reduces the coefficient of friction of the ball, making it difficult to handle and ideal for training proper ball-handling skills.

2. Description of the Related Art

Proper ball-handling skills are crucial to many sports. In football for example, the outcome of many games is determined by turnovers. More specifically, fumbles by ball carriers put a sudden end to scoring drives and create opportunities for an opponent to score and control the game clock. Therefore, the ability to teach ball carriers to perform without losing control of the ball can provide a team with an advantage over its opponents. While the present invention is directly applicable to virtually any sport that uses a ball, such as football, rugby, basketball, volleyball, and even soccer, the foregoing descriptions and references will draw primarily from football for simplicity.

Over the years, football coaches have recognized the need to teach ball-handling skills and have tried to develop methods and devices that fit that need. Two such methods have been to soak the football in water or cover it with grease or a similar lubricating substance. These methods were effective at making the footballs slippery, but were very impractical.

Most footballs, like other sport balls, have an outer layer made of leather or a synthetic material that simulates the characteristics of leather. Soaking these materials in water for extended periods of time, or covering them in grease, can be detrimental to such materials and deteriorate them over time. Moreover, a football soaked in water or covered in grease is not easily returned to its original condition for normal use. Wet leather takes several hours to dry. It could take even longer to try and clean grease out of leather, if it can be removed at all.

Therefore, there is a need for an improved method and training device for increasing ball-handling skills in a variety of sports.

SUMMARY OF THE INVENTION

The present invention consists of covers formed from flexible materials, such as fabric, for various types of sport balls that turn a game ball into a training ball for use in ball-handling drills. Conventional sport balls have outer coverings made from leather, rubber, or a synthetic material that simulates the characteristics of leather or rubber. These materials are chosen by the ball manufacturers and the sports communities for their durability and gripping characteristics. The covers of the present invention are made from flexible materials having a coefficient of friction lower than that of the outer coverings of conventional leather or rubber sport balls. The flexible material is fashioned into a pocket that snugly but removably covers the sport ball. With the original surface of the sport ball covered by the flexible material, the ball becomes "slippery" and difficult to handle. After the training drills are complete, the cover is easily removed and the ball is returned to its original game condition.

In another embodiment, a permanent training sport ball is formed by permanently attaching the flexible material to the outer cover of the sport ball. Other embodiments of the training covers, which either removably or permanently cover the sport ball, have different shapes and use less covering material to leave selected areas of the sport ball, such as the laces of a football, uncovered. Therefore, the various embodiments of the sport ball training covers are useful for several different training drills and sports.

Thus, a primary objective of the invention is to provide an improved sport ball training cover that improves the ball-handling skills of players from several different sports.

Another objective of the invention is to provide an improved sport ball training cover that has a lower coefficient of friction than that of the outer covering of the sport ball chosen to be covered.

Another objective of the invention is to provide an improved sport ball training cover that removably covers a sport ball.

Another objective of the invention is to provide an improved sport ball training cover that permanently covers a sport ball and creates a specialized training ball.

Another objective of the invention is to provide an improved sport ball training cover that leaves selected areas of a sport ball uncovered to conform to specific types of training drills.

These and other objects will be apparent to those skilled in the art.

DESCRIPTION OF THE PREFERRED EMBODIMENT

The sport ball training cover of the present invention is particularly well-suited for conventional sport balls and making them into training balls for teaching ball-handling skills. For simplicity of description, the sport ball training cover of the present invention will be described in connection with a regulation size football, but it will be understood that virtually all of the advantages of the present invention are readily applied to other types and sizes of sport balls, such as, for example, rugby balls, soccer balls, basketballs, volleyballs, softballs, and baseballs. The sports that utilize each of these different balls use a ball of regulation size, shape and weight for levels of play ranging from "pee-wee," high school, collegiate and pro. It is preferred that the ball used in conjunction with the cover of this invention be of regulation size, shape and weight to provide a training device that closely resembles the performance dynamics of a game ball.

Figure 1:
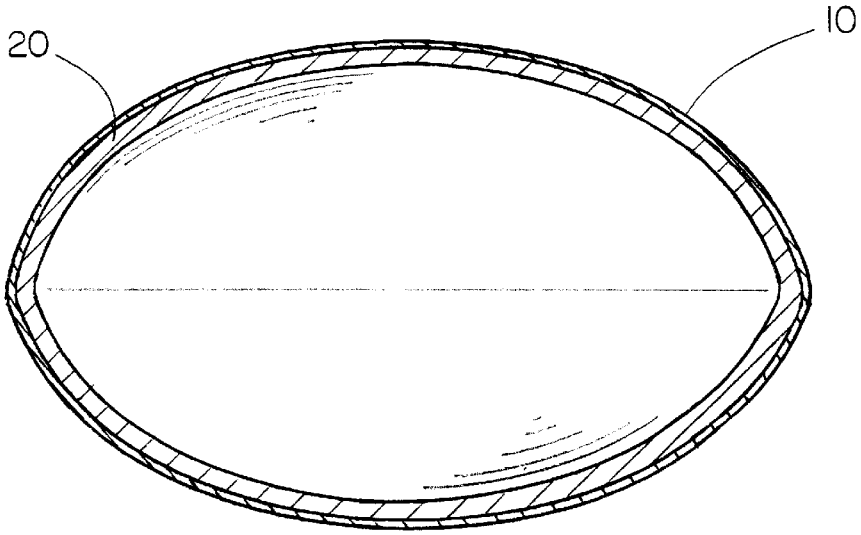
FIG. 1 is a side sectional view of the training cover as it covers a football.

A sport ball training cover 10 is shown in FIG. 1 covering a conventional football 20. One embodiment of the present invention is a removable cover 10 that is formed by constructing a pouch from a flexible material. Although several resilient fabrics and synthetic materials could be used, the preferred embodiment of the present invention uses fabric of a nylon/Lycra blend.

Figure 2:
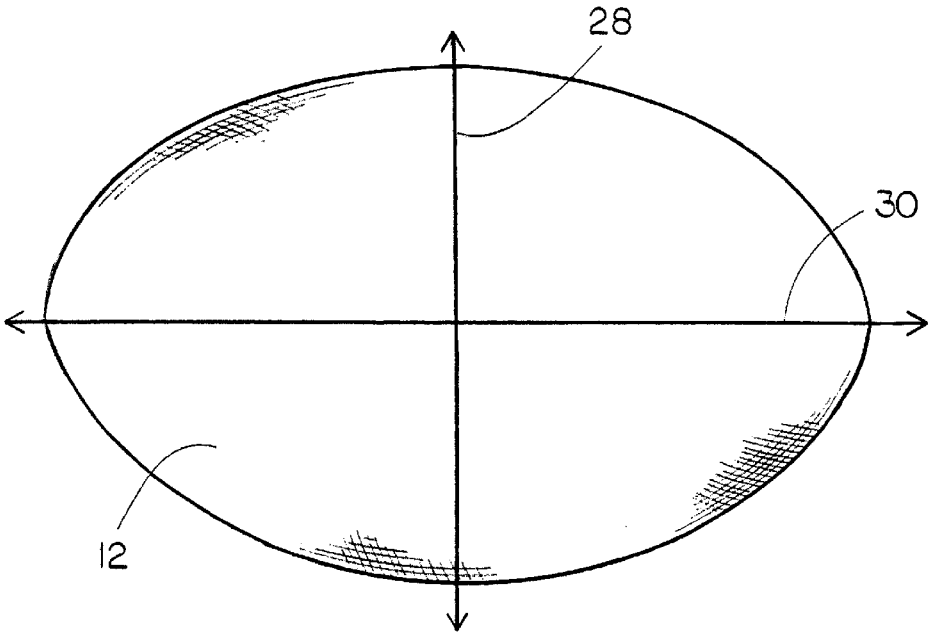
FIG. 2 shows a single flexible material panel used for covering a first half of a football.
Figure 3:
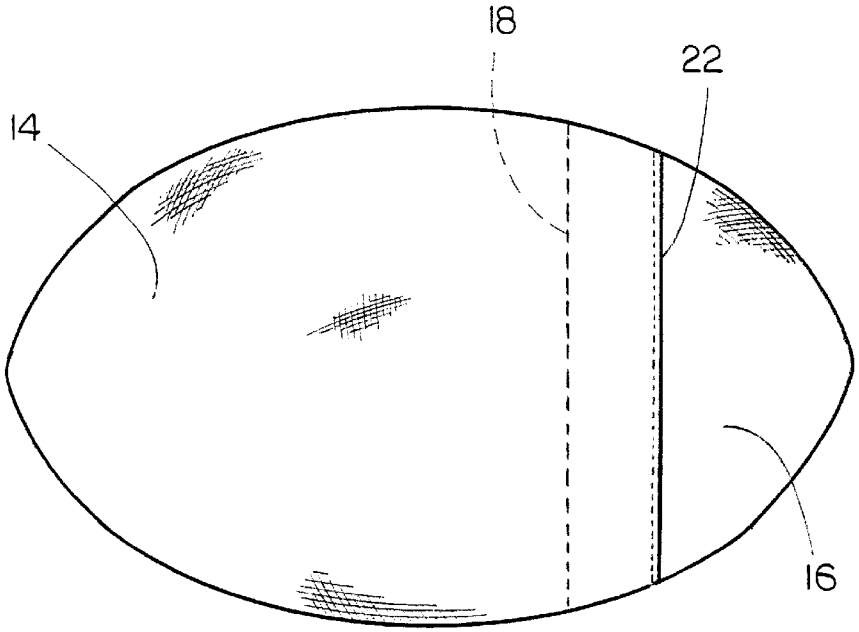
FIG. 3 shows two flexible material panels used in combination with each other for covering a second half of a football.

Panel 12, as shown in FIG. 2, is cut from the flexible material using a template having the general shape of the sport ball to be covered. The length of the transverse axis 28 of panel 12 should approximate that of the longest transverse axis of the sport ball to be covered, as it is measured along the outer surface of the sport ball. The length of the longitudinal axis 30 of panel 12 should approximate that of the longest longitudinal axis of the sport ball to be covered, as it is measured along the outer surface of the sport ball. Panel 14 and a panel 16, as shown in FIG. 3, are also cut from the flexible material using templates. The shape of the templates used to cut panel 14 and panel 16 closely resemble the template used to cut panel 12 but for the fact that they have both had one end cut off, forming edges 18 and 22. Edges 18 and 22 run parallel to the transverse axis of panels 16 and 14, respectively. When panels 14 and 16 are placed adjacent to one another so that edges 18 and 22 overlap, as shown in FIG. 3, panels 14 and 16 form a shape substantially identical to that of panel 12, having longitudinal and transverse axis lengths equal to axis 30 and 28 of panel 12.

The edges of panel 16, exclusive of edge 18, are secured to the corresponding edges of one side of panel 12 using conventional means, such as sewing. It is contemplated that the edges could also be secured using other permanent means, including a variety of adhesives, or detachable means such as Velcro, snaps, or even zippers. The edges of panel 14, exclusive of edge 22, are then secured to the corresponding edges of the other side of panel 12 so that edges 18 and 22 overlap as shown in FIG. 3.

The resulting structure is a pouch having a bottom, sides and a top having an opening formed by edges 18 and 22 in which the sport ball is selectively inserted and removed. The elasticity of the flexible material allows the pouch to expand where necessary and to envelop the sport ball snugly. With the original surfaces of the sport ball covered by the flexible material, the coefficient of friction of the sport ball's outer cover is supplanted by that of the flexible material. Therefore, it is important that the flexible material have a coefficient of friction that is at least lower than that of the sport ball's outer covering. The nylon/Lycra-blended fabric of the preferred embodiment has a substantially lower coefficient of friction than that of a regulation leather football.

In another embodiment of the present invention, the sport ball is enclosed in the training cover 10 permanently, rather than removably. This embodiment avoids the necessity of cutting panels 14 and 16 from the flexible material. Rather, a second panel 12 would be cut. Then, instead of forming a pouch with the panels as in the first embodiment, the two panels 12 would be permanently secured to the outer layer of the sport ball by conventional means, such as sewing. It is contemplated that the panels could also be secured to the sport ball using other permanent means, including a variety of adhesives. It is further contemplated that a plurality of panels, smaller than panel 12, could be secured to the outer cover of the sport ball. For example, the outer cover of a regulation football is comprised of four leather panels that are sewn together. Likewise, four flexible material panels, each approximately half the size of panel 12, could be secured to the outer cover of the sport ball to give the training sport ball the similar feel and appearance of a regulation football having four longitudinal seams.

Figure 4:
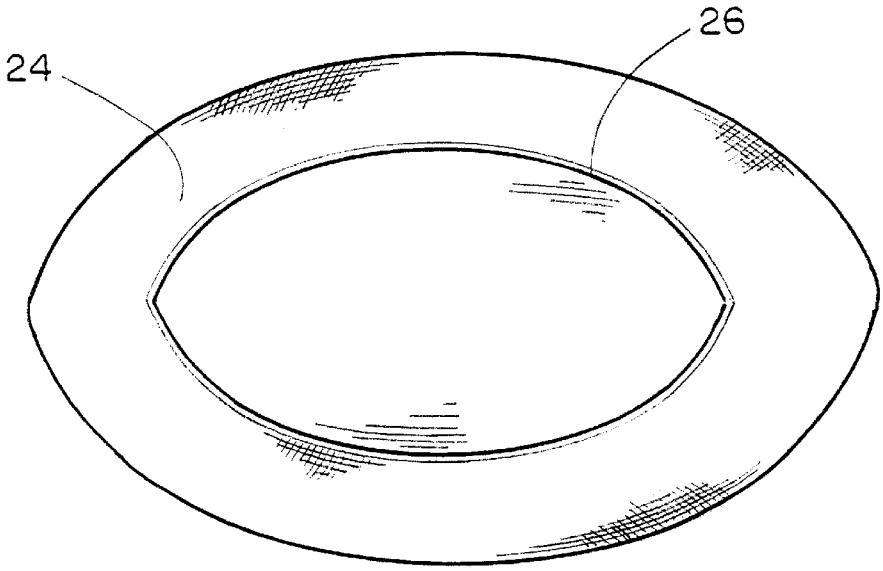
FIG. 4 shows an alternative single flexible material panel used for covering a second half of a football.

In another embodiment of the present invention, a panel 24 would be cut from the flexible material rather than cutting panels 14 and 16. An example of panel 24 is shown in FIG. 4. Panel 24 is of the same size and shape as panel 12, but would have an opening 26 formed therein. The corresponding edges of panels 12 and 24 could be secured to each other by conventional means, such as sewing, to form a pouch as described in the first embodiment above. It is contemplated that the edges could also be secured to one another using other permanent means, including a variety of adhesives, or detachable means such as Velcro, snaps, or even zippers. If it is desired to have the present embodied cover permanently attached to the sport ball, panels 12 and 24 could be permanently attached to the sport ball in the manner described in the second embodiment herein above.

Regardless of the method used to secure the cover to the sport ball in the present embodiment, opening 26 would selectively expose a portion of the outer cover of the sport ball, such as the laces and surrounding area of a football. This option allows the training sport ball to be used for a variety of training drills. For example, with the laces of a football exposed, a quarterback will have a sufficient grip to throw the training ball as he would a game ball. However, the remaining portions of the training ball will be covered by the flexible material, allowing receivers to practice catching slippery game balls, typically caused by adverse weather.

In the drawings and in the specification, there has been set forth preferred embodiments of the invention and although specific items are employed, these are used in a generic and descriptive sense only and not for purposes of limitation. Changes in the form and proportion of parts, as well as in the substitution of equivalents, are contemplated as circumstances may suggest or render expedient without departing from the spirit or scope of the invention as further defined in the following claims.

Thus it can be seen that the invention accomplishes at least all of its stated objectives.

We claim:

1. A sports training device, comprising:

a sport ball having an exterior surface; and a cover having an outer surface and an inner surface; said inner surface of said cover being operatively secured to the exterior surface of said sport ball so that said cover cannot be removed from said sport ball; said outer surface of said cover having a coefficient of friction less than the coefficient of friction of the exterior surface of said sport ball.

2. The sports training device of claim 1 wherein said sport ball has a weight at least similar to a regulation sport ball to provide the sports training device with realistic dynamic characteristics.

3. The sports training device of claim 1 wherein said sport ball has a shape and size at least similar to a regulation sport ball to provide the sports training device with realistic dynamic characteristics.

4. The sports training device of claim 1 wherein said sport ball has a weight, shape and size at least similar to a regulation sport ball to provide the sports training device with realistic dynamic characteristics.

5. The sports training device of claim 1 wherein said cover is comprised of a flexible material.

6. The sports training device of claim 5 wherein said flexible material comprises a fabric having elastic characteristics.

7. The sports training device of claim 6 wherein said fabric is comprised of nylon.

8. The sports training device of claim 1 wherein said cover has one or more openings formed therein that remain open, allowing selected portions of the exterior surface of the sport ball to remain uncovered.

9. A sports training device, comprising:

a regulation sport ball having an exterior surface; and a cover having an outer surface and an inner surface; said inner surface of said cover being operatively secured to the exterior surface of said regulation sport ball so that said cover cannot be removed from said regulation sport ball; said exterior outer surface of said cover having a coefficient of friction less than the coefficient of friction of the outer surface of said regulation sport ball.

10. The sports training device of claim 9 wherein said cover has one or more openings formed therein that remain open, allowing selected portions of the exterior surface of the sport ball to remain uncovered.

* * * * *